US007202432B2

(12) United States Patent
Nishimura

(10) Patent No.: US 7,202,432 B2
(45) Date of Patent: Apr. 10, 2007

(54) SWITCH

(75) Inventor: Kenji Nishimura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 11/400,234

(22) Filed: Apr. 10, 2006

(65) Prior Publication Data

US 2006/0254901 A1 Nov. 16, 2006

(30) Foreign Application Priority Data

May 16, 2005 (JP) ..... 2005-142641

(51) Int. Cl.
*H01H 15/02* (2006.01)
*H01H 21/18* (2006.01)

(52) U.S. Cl. ..... 200/563; 200/16 D; 200/559

(58) Field of Classification Search .... 200/16 R–16 D, 200/520, 530–532, 536, 549, 550, 553, 561–563, 200/339, 61.41, 557–559, 572
See application file for complete search history.

(56) References Cited

U.S. PATENT DOCUMENTS 3,912,895 A * 10/1975 Plana ..... 200/562
4,012,608 A * 3/1977 Lockard ..... 200/16 D
5,278,370 A * 1/1994 Miyata et al. ..... 200/244
5,796,058 A * 8/1998 Aimi et al. ..... 200/16 D
5,967,302 A * 10/1999 Lin ..... 200/550
6,222,144 B1 * 4/2001 Nishikawa ..... 200/537
6,525,285 B2 * 2/2003 Kudo et al. ..... 200/559
6,559,401 B2 * 5/2003 Minami et al. ..... 200/559
6,917,008 B1 * 7/2005 Ni ..... 200/563
7,019,243 B2 * 3/2006 Tsuda et al. ..... 200/559
7,041,919 B2 * 5/2006 Nishimura et al. ..... 200/61.41

FOREIGN PATENT DOCUMENTS

JP 2005-026035 1/2005

* cited by examiner

*Primary Examiner*—Michael A. Friedhofer
(74) *Attorney, Agent, or Firm*—Wenderoth, Lind & Ponack, L.L.P.

(57) ABSTRACT

A switch comprises a case having a stationary contact embedded in an inner bottom surface thereof, a lever housed inside the case such that the lever is swingable around one end thereof, and a movable contact having an arm portion and a contact point on a first end of the arm portion, the contact point being slidable on any of the inner bottom surface of the case and the stationary contact while maintaining flexible contact therewith in response to a swinging motion of the lever. The movable contact is also provided with a holding portion at a second end of the arm portion, and the holding portion is embedded in the lever by insert molding.

10 Claims, 4 Drawing Sheets

SWITCH

FIELD OF THE INVENTION

The present invention relates to switches used mainly for detecting presence or absence of storage media, operation of mechanisms and the like in a variety of electronic apparatuses.

BACKGROUND OF THE INVENTION

In the recent trend of advancement in downsizing and high performance of a variety of electronic apparatuses such as video tape recorders and personal computers, there is a demand for switches of small size, low profiling and high functional reliability for use in such applications as detecting presence or absence of storage media like tapes and disks, and operation of mechanisms such as knobs and doors.

Referring now to FIG. 5, description is provided of one such switch of the prior art. FIG. 5 is a sectional view of a conventional switch. In this figure, case 1 is made of an insulating resin in a box-like shape having an open top. A plurality of stationary contacts 2 made of an electrically conductive sheet metal are embedded in an inner bottom surface of case 1, and terminals (not shown) of these stationary contacts 2 are extended individually to the outside of case 1.

Lever 3 made of an insulating resin is housed inside case 1 in a manner so that it is swingable around fulcrum portion 31 at the left end, and it has actuating portion 32 of an upwardly protruding shape formed at the right end.

Movable contact 4 made of a flexible metal sheet is curved in the middle portion and it is housed inside case 1 with a small elastic flexure. Contact point 41 on one end of movable contact 4 is flexibly contacted with inner bottom surface of case 1, and stationary portion 42 at the other end is retained by projection 33 on the underside of lever 3.

In addition, cover 5 made of a thin metal sheet covers the upper opening of case 1, and actuating portion 32 of lever 3 protrudes upward from through hole 51 of cover 5.

The conventional switch of the structure shown here is so constructed that, first, movable contact 4 is inserted from the upper side into case 1 bearing stationary contacts 2 laid securely by such a method as insert molding in the inner bottom surface of the case 1, and lever 3 is then disposed inside case 1 such that projection 33 abutted against stationary portion 42 of movable contact 4 and bends movable contact 4.

Afterward, cover 5 is placed to close the upper opening of case 1 and fixed to the exterior wall of case 1 to complete assembly of the switch.

The switch assembled in this manner is mounted on a wiring board (not shown) provided with a wiring pattern, and the terminals of stationary contact 2 extending from case 1 are soldered to predetermined traces of the wiring pattern to establish electrical connections to an electronic circuit of an apparatus.

In the structure described above, lever 3 swings downward around fulcrum portion 31 when the portion of actuating portion 32 that protrudes above case 1 is pressed downward by any operation such as insertion or removal of a storage medium like a tape or a disk, or moving a knob or a door.

This makes the underside of actuating portion 32 depress the middle portion of movable contact 4, which in turn causes contact point 41 at the end of movable contact 4 to slide in a direction of stationary contacts 2 on the left side while maintaining its flexible contact with the inner bottom surface of case 1.

When actuating portion 32 is pressed a certain amount, contact point 41 comes into movable contact with stationary contacts 2. As a result, an electrical continuity is established among the plurality of stationary contacts 2 through movable contact 4.

When the pressing force on lever 3 is removed, lever 3 is thrust and swung back upward by a restoring force of movable contact 4. This causes contact point 41 to slide from stationary contacts 2 toward the right side while maintaining the flexible contact with the inner bottom surface of case 1, and return to the original position. As a result, the electrical continuity among the plurality of stationary contacts 2 is broken.

Japanese Patent Unexamined Publication, No. 2005-26035 is one example of the prior art references related to the present invention.

The prior art switch discussed above has a problem, however, that movable contact 4 is liable to become dislodged or deformed when being assembled since movable contact 4 is disposed in case 1 beforehand and lever 3 is placed inside case 1 while forcing movable contact 4 to bend, which also requires extra time for assembling.

SUMMARY OF THE INVENTION

A switch of the present invention comprises a case having a stationary contact embedded in an inner bottom surface thereof, a lever housed inside the case in a swingable manner around one end thereof, and a movable contact having an arm portion, wherein a contact point on a first end of the arm portion is slidable on any of the inner bottom surface of the case and the stationary contact while maintaining flexible contact therewith in response to a swinging motion of the lever. In addition, the movable contact is provided with a retained portion at a second end of the arm portion, and the retained portion is embedded in the lever by insert molding.

According to this structure, the movable contact is retained securely in the lever since the retained portion at the second end of the arm portion is embedded inside the lever by the insert molding. For this reason, the switch can be assembled easily without having the movable contact dislodged or deformed during assembling. In addition, the invention can provide the switch with the movable contact capable of functioning reliably during switching operations.

DETAILED DESCRIPTION OF PREFERRED EMBODIMENT

Description is provided hereinafter of an exemplary embodiment of the present invention with reference to FIG. 1 through FIG. 4.

Figure 1:
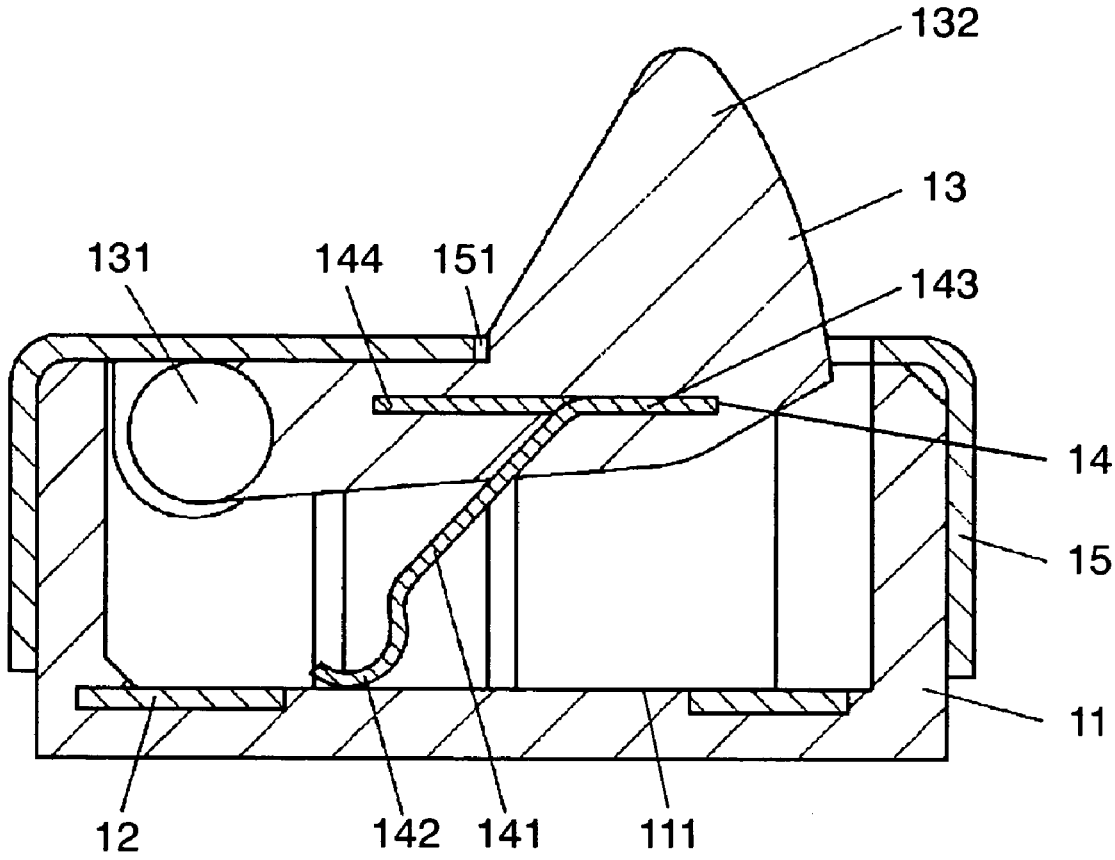
FIG. 1 is a sectional view of a switch according to an exemplary embodiment of the present invention.
Figure 2:
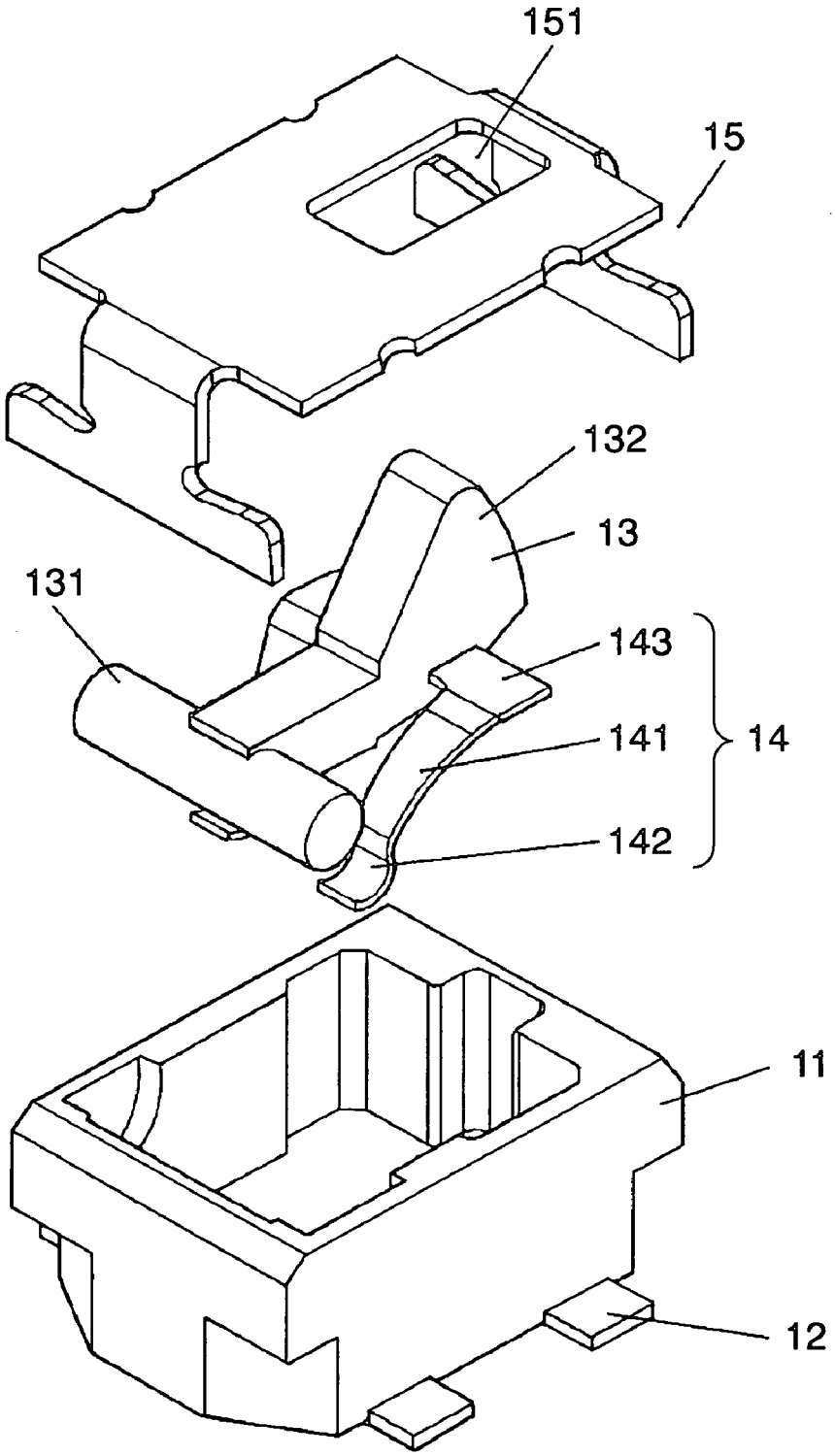
FIG. 2 is an exploded perspective view of the switch shown in FIG. 1.
Figure 3:
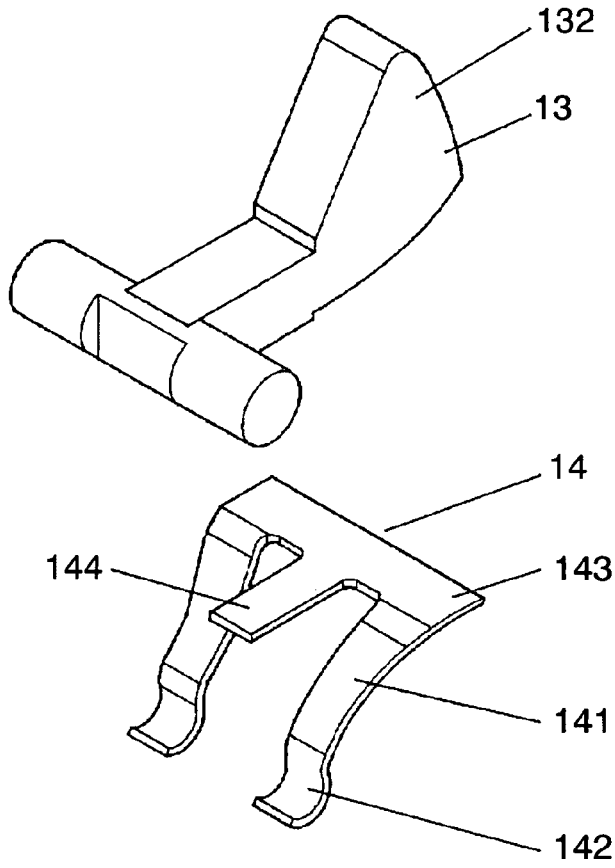
FIG. 3 is an exploded perspective view of an elemental portion of the switch shown in FIG. 1.
Figure 4:
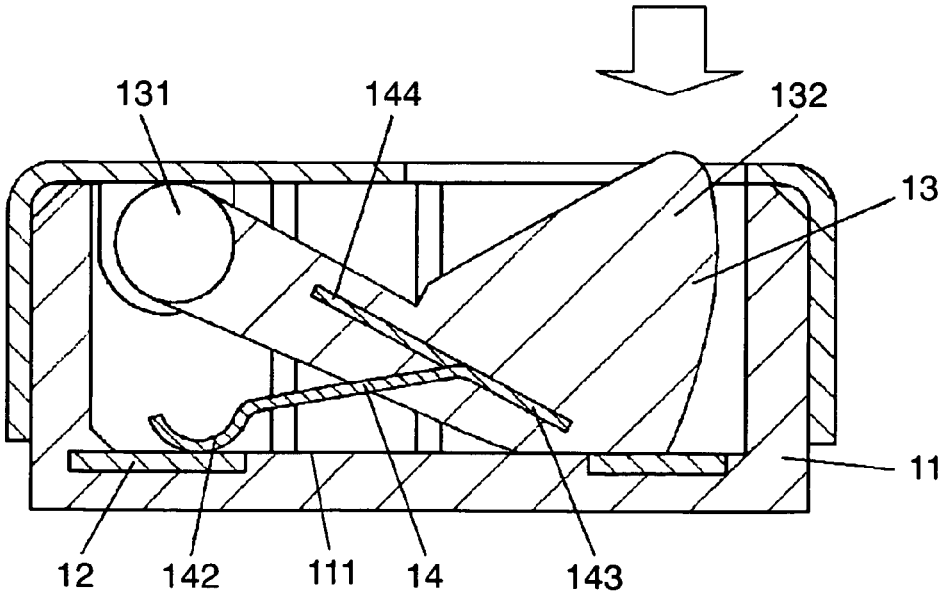
FIG. 4 is a sectional view of the switch shown in FIG. 1 as it is operated.
Figure 5:
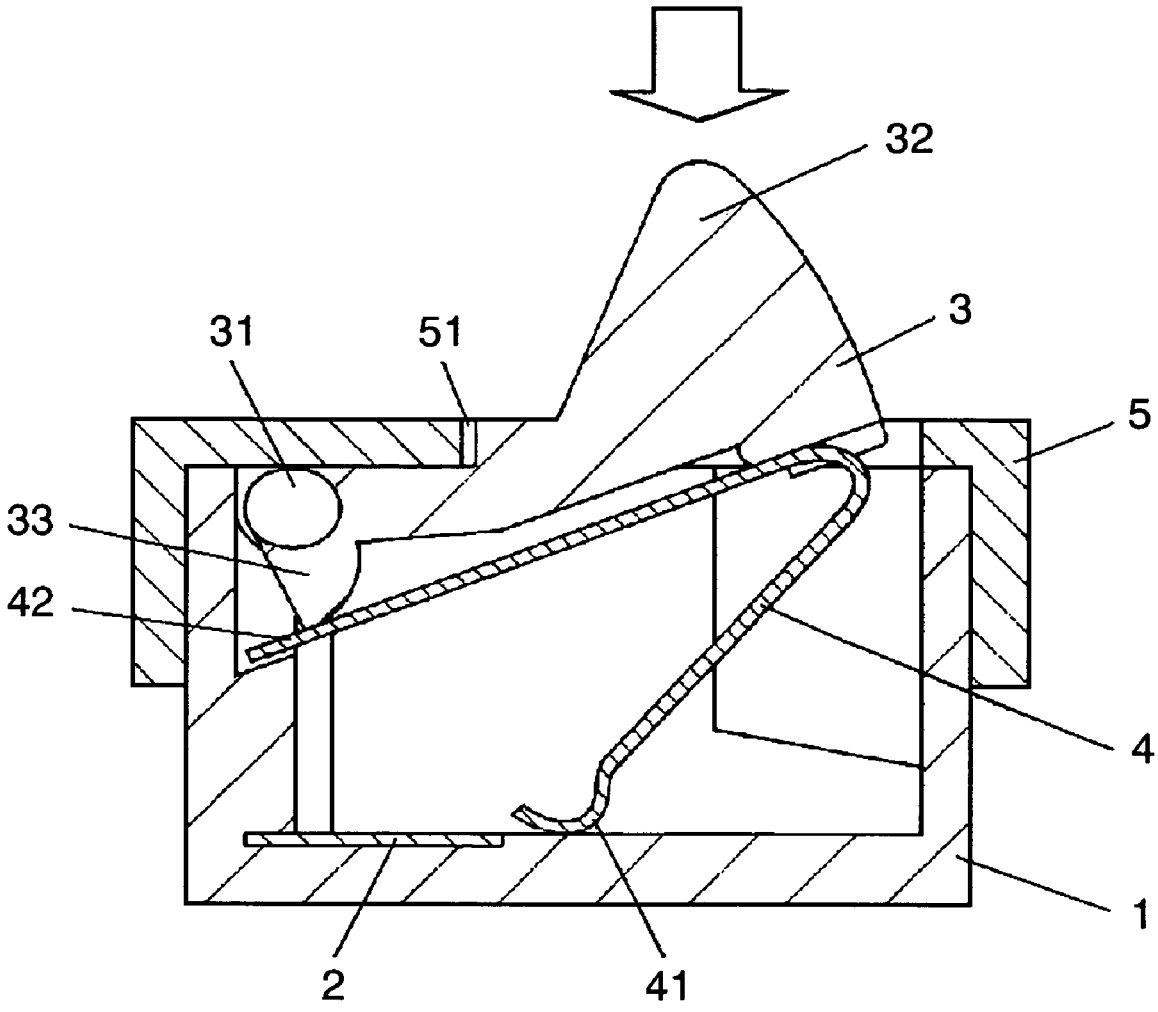
FIG. 5 PRIOR ART
FIG. 5 is a sectional view of a switch of the prior art.

FIG. 1 is a sectional view of the switch according to the exemplary embodiment of this invention, FIG. 2 is an exploded perspective view of the switch shown in FIG. 1, FIG. 3 is an exploded perspective view of an elemental portion of the switch shown in FIG. 1, and FIG. 4 is a sectional view of the switch shown in FIG. 1 as it is operated.

In FIG. 1 through FIG. 3, the switch of this exemplary embodiment comprises case 11 having stationary contacts 12 embedded in inner bottom surface 111, lever 13 housed inside case 11 in a manner swingable around one end thereof, and movable contact 14 having arm portions 141. Contact point 142 provided on a first end of each arm portion 141 is slidable along inner bottom surface 111 of case 11 and stationary contacts 12 while maintaining movable contact therewith in response to a swinging motion of lever 13. Movable contact 14 is also provided with retained portion (holding portion) 143 at a second end of each arm portion 141, and retained portion 143 is embedded in lever 13 by insert molding. As shown in FIGS. 1, 2 and 4, retained portion 143 is fully embedded in a body of the lever 13.

It is desirable that movable contact 14 is so composed as to have reed portion (tongue portion) 144 formed in a manner to extend from retained portion 143 in a single plane as shown in FIGS. 1 and 4, and that both retained portion 143 and reed portion 144 are insert-molded in lever 13.

Description will be provided in more detail of the structure of the switch of this exemplary embodiment.

In FIG. 1 through FIG. 3, case 11 is made of an insulating resin such as liquid crystalline polymer and polyphenylene sulfide, and it has a box-like shape with an opening in the top surface. A plurality of stationary contacts 12 made of an electrically conductive sheet metal such as copper alloy are securely embedded in inner bottom surface 111 of case 11 by insert molding, and their terminals are extended individually to the outside of case 11.

Lever 13 is formed of an insulating resin such as liquid crystalline polymer and nylon. Lever 13 is housed inside case 11 so as to be swingable around fulcrum portion 131 at the left end, and it has actuating portion 132 formed into an upwardly protruding shape at the right end.

Movable contact 14 is made of a flexible sheet metal such as copper alloy. This movable contact 14 is housed inside case 11 with its two arm portions 141 elastically bent slightly. Both arm portions 141 have their respective contact points 142 of generally an arcuate shape formed at the left ends (i.e., first ends) that flexibly and slidably contact inner bottom surface 111 of case 11. Retained portion 143 is formed to connect both arm portions 141 at their right ends (i.e., second ends). The intermediate portion of this retained portion 143 is insert-molded in actuating portion 132 of lever 13.

In addition, movable contact 14 is provided with reed portion 144 in a manner to extend from the center (connection part) of retained portion 143 of movable contact 14. This reed portion 144 is also insert-molded in lever 13 together with retained portion 143. When insert-molded in lever 13, this reed portion 144 lies along a direction extending from retained portion 143 of movable contact 14 toward fulcrum portion 131 of lever 13, as illustrated in FIG. 1.

Cover 15 is made of a thin metal sheet such as a copper plate. This cover 15 encloses the upper opening in case 11, and actuating portion 132 of lever 13 protrudes upward from through hole 151 of cover 15.

The switch constructed in the above manner has stationary contacts 12 embedded and secured by insert molding or the like method into inner bottom surface 111 of case 11. Retained portion 143 and reed portion 144 of movable contact 14 are insert-molded in actuating portion 132 of lever 13 to integrate lever 13 and movable contact 14 into a single component.

The integrated component of lever 13 and movable contact 14 is inserted in case 11 from above so that lever 13 is housed inside case 11 with a pre-stressing force to bend arm portions 141. The opening in case 11 is then closed with cover 15, and cover 15 is fixed to the exterior wall or the like part of case 11. Assembly of the switch of this exemplary embodiment is hence completed as discussed above.

In other words, the switch is so constructed that it can be assembled with only three components including case 11 having stationary contacts 12 embedded therein, lever 13 having movable contact 14 insert-molded therewith, and cover 15.

Movable contact 14 is retained securely in lever 13 since retained portion 143 at its right end and reed portion 144 extending from retained portion 143 are insert-molded in lever 13. The switch can thus be assembled by simply inserting lever 13 into case 11 from above while making arm portions 141 bend smoothly.

That is, the switch is so constructed that it can be assembled easily without having movable contact 14 dislodged or deformed during the assembling, and allows movable contact 14 to function reliably when operated.

The switch assembled in this manner is mounted on a wiring board (not shown) provided with plural traces of wiring pattern on both upper and lower sides thereof, and the terminals of stationary contacts 2 extending from case 11 are soldered to predetermined traces of the wiring pattern to establish electrical connections to an electronic circuit of an apparatus.

In the structure described above, lever 13 swings downward around fulcrum portion 131, as shown in the sectional view of FIG. 4, when actuating portion 132 protruding above case 11 is pressed downward by any operation such as insertion or removal of a storage medium like a tape or a disk, or moving a knob or a door.

In response to this swinging motion of lever 13, contact points 142 at the left end of movable contact 14 slide on inner bottom surface 111 of case 11 in a direction of stationary contacts 12 on the left side while maintaining the flexible contact with inner bottom surface 111 since the right end of movable contact 14 is retained by lever 13. When actuating portion 132 is pressed a certain amount, contact points 142 come into flexible contact with stationary contacts 12. As a result, an electrical continuity is established between the plurality of stationary contacts 12 through movable contact 14.

When the operating force on lever 13 is removed, lever 13 is thrust and swung back upward by a restoring force of the flexible movable contact 14. This causes contact points 142 to slide from stationary contacts 12 toward the right side while maintaining the flexible contact to inner bottom surface 111 of case 11, and return to the original position shown in FIG. 1. As a result, the electrical continuity between the plurality of stationary contacts 12 is broken.

Here, reed portion 144 of movable contact 14 is fixed to lever 13 by insert molding in addition to retained portion 143. Since the insert molding of reed portion 144 further reinforces the retention of movable contact 14 in lever 13, movable contact 14 is not likely to come off or break off from lever 13 even after repeated operation of swinging lever 13.

In other words, reed portion 144 ensures operation of movable contact 14 more reliably when subjected to the swinging motion, thereby achieving steady operation of making and breaking the electrical continuity between movable contact 14 and stationary contacts 12.

According to the present exemplary embodiment, as discussed, contact points 142 on the first ends of arm portions 141 of movable contact 14 slide along inner bottom surface 111 of case 11 and stationary contacts 12 while maintaining the flexible contact therewith in response to the swinging motion of lever 13. Movable contact 14 is provided with retained portion 143 at the second ends of arm portions 141 so that this retained portion 143 is insert-molded in lever 13. Since this structure ensures positive retention of movable contact 14 in lever 13, the switch can be assembled easily without likeliness of movable contact 14 being dislodged or deformed during the assembling. The invention can thus provide the switch with movable contact 14 capable of functioning reliably during the operation.

In addition, movable contact 14 has reed portion 144 formed in an extending manner from retained portion 143, and both retained portion 143 and reed portion 144 are insert-molded in lever 13, which further improves firmness of the insertion of movable contact 14 in lever 13. This structure further ensures reliable function of movable contact 14 during the operation, and thereby achieves steady operation of making and breaking the electrical continuity between movable contact 14 and stationary contacts 12.

What is claimed is:

1. A switch comprising:

a case;

at least one stationary contact embedded in an inner bottom face of said case;

a lever having a first end serving as a fulcrum part and swingably mounting said lever in said case for swingable movement between a rest position and a pressed position, said lever being formed of insulating resin;

a movable contact comprising an elastic metallic plate mounted to said lever;

wherein said movable contact includes an arm portion having first and second end portions;

wherein said arm portion includes a contact part at said first end portion, said contact part being configured and arranged for slidable contact along said stationary contact and said inner bottom face of said case;

wherein said movable contact further includes, at said second end portion of said arm portion, a holding portion and a tongue extending from said holding portion; and wherein both said holding portion and said tongue of said movable contact are embedded within a body of said lever.

2. The switch of claim 1, wherein said holding portion has a proximal side and a distal side;

said arm portion is connected at said proximal side of of said holding portion and extends therefrom toward said inner bottom face of said case; and said tongue portion is connected to said proximal side of said holding portion and extends therefrom in a direction away from said distal side of said holding portion.

3. The switch of claim 2, wherein said holding portion and said tongue portion extend from one another in a single plane.

4. The switch of claim 2, wherein said holding portion and said tongue portion are connected to one another at a connection part; and said connection part is fully embedded within said body of said lever so as to be unexposed outwardly of said body of said lever.

5. The switch of claim 2, wherein said holding portion extends from said proximal side to said distal side in a first direction; and each of said tongue portion and said arm portion extends from said proximal side of said holding portion in a direction having at least a directional component in a second direction opposite said first direction.

6. The switch of claim 2, wherein said at least one stationary contact comprises plural stationary contacts.

7. The switch of claim 1, wherein said holding portion and said tongue portion extend from one another in a single plane.

8. The switch of claim 1, wherein said holding portion and said tongue portion are connected to one another at a connection part; and said connection part is fully embedded within said body of said lever so as to be unexposed outwardly of said body of said lever.

9. The switch of claim 1, wherein said holding portion extends in a first direction; and each of said tongue portion and said arm portion extends from said holding portion in a direction having at least a directional component in a second direction opposite said first direction.

10. The switch of claim 1, wherein said at least one stationary contact comprises plural stationary contacts.

* * * * *